United States Patent [19]

Hughes

[11] Patent Number: 4,893,397

[45] Date of Patent: Jan. 16, 1990

[54] FIRE-RESISTANT CONTAINER AND METHOD OF ASSEMBLING SAME

[75] Inventor: John T. Hughes, Cromwell Crescent, United Kingdom

[73] Assignee: Micropore International Limited, Worcestershire, United Kingdom

[21] Appl. No.: 125,453

[22] Filed: Nov. 25, 1987

[30] Foreign Application Priority Data

Nov. 27, 1986 [GB] United Kingdom ..... 8628424

[51] Int. Cl.[4] ..... B61O 39/03

[52] U.S. Cl. ..... 29/428; 220/3.1; 312/214; 109/65; 109/59 R; 292/DIG. 66

[58] Field of Search ..... 312/214; 29/455 R; 292/DIG. 65, DIG. 66; 109/47, 49, 50, 59 R, 65; 49/7; 220/400, 3.1

[56] References Cited

U.S. PATENT DOCUMENTS

| | | | |
|---|---|---|---|
| 3,501,215 | 3/1970 | Gartner . | |
| 3,559,594 | 2/1971 | Miller . | |
| 3,705,754 | 12/1972 | Drum et al. . | |
| 3,762,787 | 10/1973 | Grubb . | |
| 3,826,552 | 7/1974 | Anderson . | |
| 4,015,869 | 4/1977 | Horvath | 292/DIG. 66 |
| 4,183,565 | 1/1980 | Allemann | 292/DIG. 66 |
| 4,257,656 | 3/1981 | Rothhaas et al. . | |
| 4,303,286 | 12/1981 | McClellan | 312/214 |
| 4,373,450 | 2/1983 | Miller et al. . | |
| 4,413,869 | 11/1983 | Pichler et al. . | |
| 4,574,454 | 3/1986 | Dyson | 312/214 X |
| 4,685,402 | 8/1987 | Nelson et al. | 312/214 X |

FOREIGN PATENT DOCUMENTS

| | | |
|---|---|---|
| 0169802 | 1/1986 | European Pat. Off. . |
| 2153886 | 4/1973 | France . |
| 562232 | 6/1944 | United Kingdom . |
| 1086758 | 10/1967 | United Kingdom . |
| 1365741 | 9/1974 | United Kingdom . |
| 2071485A | 8/1981 | United Kingdom . |
| 2071485 | 9/1981 | United Kingdom . |
| 2168402A | 6/1986 | United Kingdom . |

*Primary Examiner*—Joseph Falk

*Attorney, Agent, or Firm*—Browdy and Neimark

[57] ABSTRACT

A fire-resistant container for magnetic media is constructed by mounting a base of thermal insulation material within a casing having an open face and by positioning on the base and securing to the base a body of thermal insulation material so as to define with the base a cavity which is open towards the open face of the casing. An inner container is positioned within the cavity so as to have an opening towards the open face of the casing and has an inner wall defining a storage cavity and an outer wall which defines a chamber filled with heat absorbing material between the inner and outer walls. A storage drawer is inserted into the storage cavity and has attached thereto a container located on that side of the drawer adjacent to the opening, the container being filled with a heat absorbing material. A layer of thermal insulation material is positioned on that side of the container remote from the drawer and a facing is located on that side of the layer of insulation material remote from the container.

4 Claims, 5 Drawing Sheets

FIRE-RESISTANT CONTAINER AND METHOD OF ASSEMBLING SAME

FIELD OF THE INVENTION

The present invention relates to a fire-resistant container for protecting magnetic media such as so-called floppy discs from fire and to a method of assembling the container in a filing cabinet or the like.

DESCRIPTION OF PRIOR ART

Fire-resistant containers or safes are known for protecting magnetic media from damage by fire. Some containers are known which incorporate a heat absorbing material such as a phase change material, but it is conventional to use a combination of traditional insulation and water-bearing cement between an inner container and an outer casing. Access in the form of a lid or door is provided and the seal between the lid or the like and the remainder of the container is generally shaped as a stepped labyrinth to prevent the passage of infrared heat or flame during a fire. Such a safe is known, for example, from U.S. Pat. No. 3 559 594.

The problem with such safes is that they are bulky and extremely heavy. This makes them difficult to install in a building and difficult to move. They are therefore difficult to site at the most desirable location and for this reason may not be used for storing important data. These known safes are also relatively expensive to purchase and therefore are not employed by a considerable number of potential users who risk total loss of their valuable data.

OBJECT OF THE INVENTION

It is an object of the present invention to provide a fire-resistant container for magnetic media which is lightweight and readily moved. It also an object to provide such a fire-resistant container which is relatively inexpensive but still able to give protection to floppy discs and other magnetic media.

SUMMARY OF THE INVENTION

According to one aspect of the present invention there is provided a fire-resistant container for magnetic media, which container comprises:

a base of thermal insulation material for mounting securely within a casing having an open face;

a body of thermal insulation material to be positioned on the base and to be secured thereto so as to define with the base a cavity which is open towards the open face of the casing;

an inner container to be positioned within the cavity so as to have an opening towards the open face of the casing, the inner container having an inner wall defining a storage cavity and an outer wall so as to define a chamber between the outer wall and the inner wall;

a heat absorbing material filling the chamber; and a storage drawer slidably locatable in the storage cavity and having attached thereto a container located on that side of the drawer adjacent to the opening which container is filled with a heat absorbing material, a layer of thermal insulation material positioned on that side of the container remote from the drawer, and a facing located on that side of the layer of insulation material remote from the container.

The casing may be a conventional filing cabinet with access to the magnetic media being obtained by way of the sliding drawer. The facing of the storage drawer permits compatiblity with a wide range of filing cabinets.

Preferably, the base of thermal insulation material is positioned in a metal tray.

The fire-resistant container may include vertically adjustable angle brackets for mounting the base of thermal insulation material within the casing, which brackets are adapted to extend along both longitudinal sides of the base and to engage upon a mounting rail provided within the casing. Additionally, the fire-resistant container may include vertically adjustable angle brackets for positioning the body of thermal insulation material on the base, which brackets are adapted to extend along both longitudinal sides of the body of thermal insulation material and to engage upon a mounting rail provided within the casing.

We have found that substantially all commercially-available filing cabinets have a slide mechanism for carrying the filing drawers. While the details o such slide mechanisms vary considerably we have found that it is common practice to employ a rigid bracket which extends longitudinally along both sides of the casing of the filing cabinet and which provides us with a suitable mounting rail.

The fire-resistant container preferably includes a slide mechanism for supporting the rear of the storage drawer when the storage drawer is withdrawn from the storage cavity.

Advantageously the fire-resistant container includes a plurality of heat-activated bolts for securing the storage drawer in the storage cavity in the event of the fire-resistant container being exposed to a predetermined elevated temperature such as would be experienced during a fire. Such an arrangement avoids the need for any special handles or locks during everyday use but provides secure locking of the storage drawer during a fire.

According to a second aspect of the present invention there is provided a method of assembling a fire-resistant container for magnetic media, which method comprises the steps of:

fitting a base of thermal insulation material securely to a casing having an open face;

positioning on the base a body of thermal insulation material which incorporates a heat absorbing material and securing the body to the base so as to define with the base a storage cavity which opens towards the open face of the casing; and inserting into the storage cavity a storage drawer having a facing to co-operate with the open face of the casing which storage drawer is provided with a body of thermal insulation material incorporating a heat absorbing material, which body, in use, co-operates with the body defining the storage cavity so as to close and insulate the storage cavity.

The base of thermal insulation material may be mounted within the casing by way of vertically adjustable angle brackets which extend along both longitudinal sides of the base and engage upon a mounting rail provided within the casing.

The body of thermal insulation material may be positioned on the base by way of vertically adjustable angle brackets which extend along both longitudinal sides of the body of thermal insulation material and engage upon a mounting rail provided within the casing. Advantageously, rollers are provided on the angle brackets attached to the body of thermal insulation material to facilitate positioning of the body of thermal insulation material relative to the base.

For a better understanding of the present invention and to show more clearly how it may be carried into effect reference will now be made, by way of example, to the accompanying drawings in which:

DESCRIPTION OF PREFERRED EMBODIMENT

Figure 1:
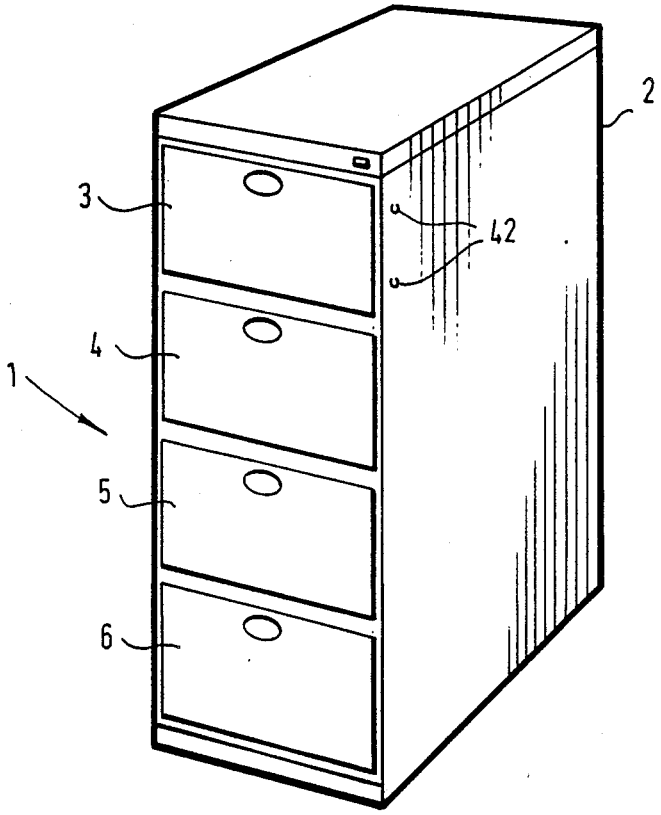
FIG. 1 is a perspective view of a conventional filing cabinet which has been modified to bring it into accordance with the present invention.

FIG. 1 shows a conventional filing cabinet 1 which typically comprises an outer casing 2 of metal such as steel or wood and a plurality of filing drawers 3, 4, 5, 6 which are slidably mounted in the outer casing 2 by means not shown. The uppermost filing drawer 3 is constructed as a fire-resistant container in co-operation with the remainder of the filing cabinet 1 as will be explained in more detail hereinafter.

Figure 2:
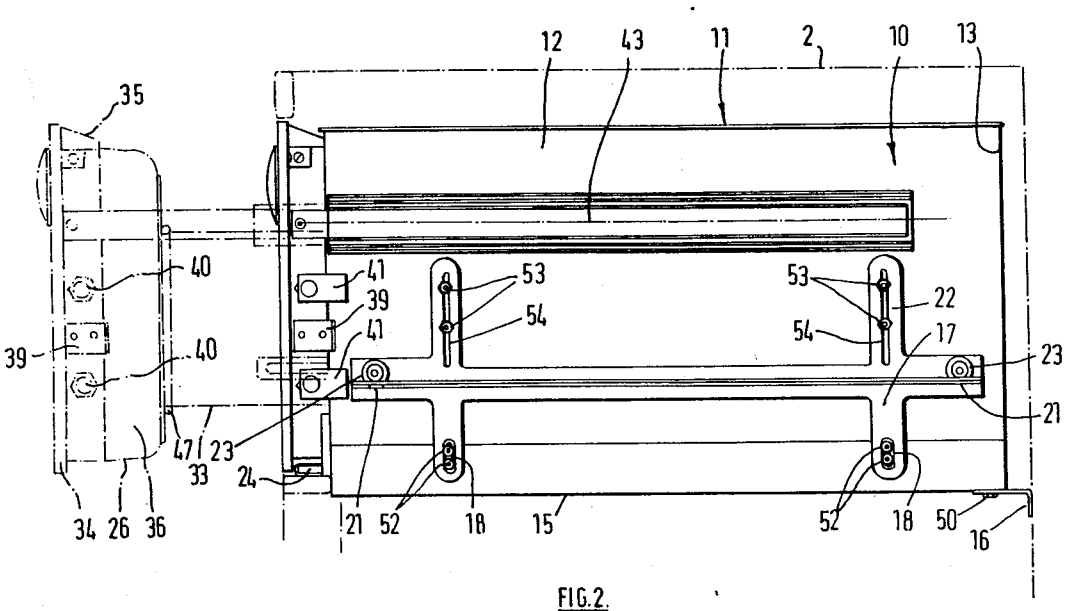
FIG. 2 is an elevational view of a fire-resistant container mounted in a conventional filing cabinet with the side of the filing cabinet removed for clarity.

FIG. 2 is a view of the upper region of the filing cabinet 1 with the side of the cabinet removed to show the external features of the uppermost filing drawer 3 and modifications to the outer casing 2.

Figure 3:
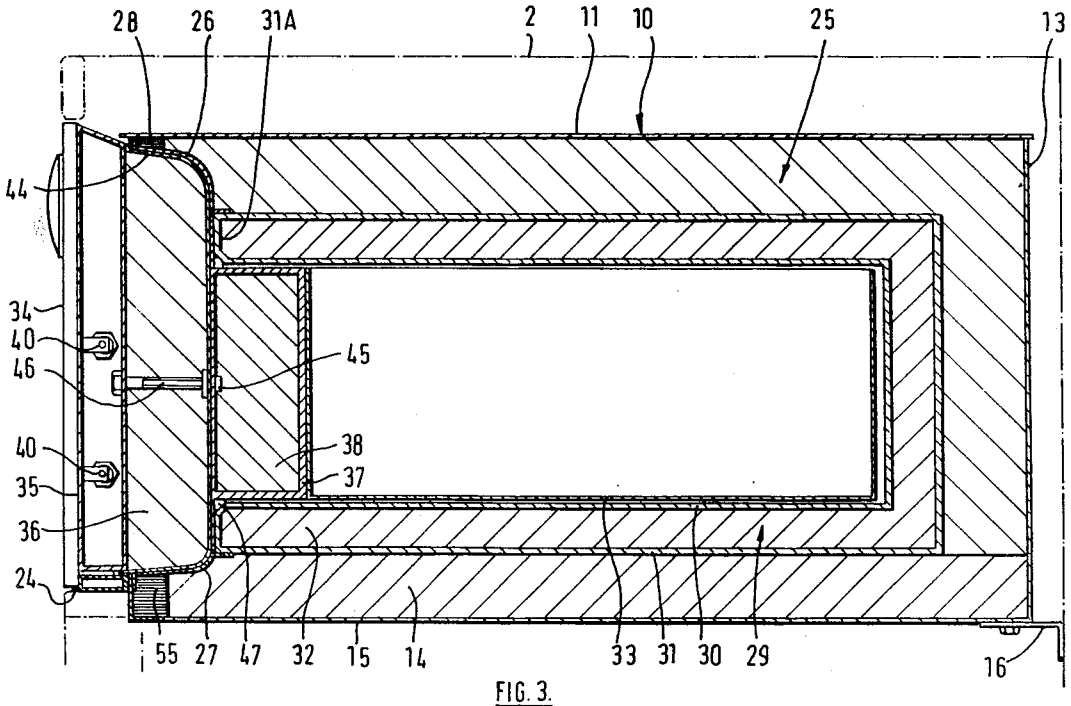
FIG. 3 is a sectional elevation through the fire-resistant container shown in FIG. 2.

FIG. 3 is a sectional view corresponding to the view shown in FIG. 2 showing the internal features of the uppermost filing drawer 3.

Figure 4:
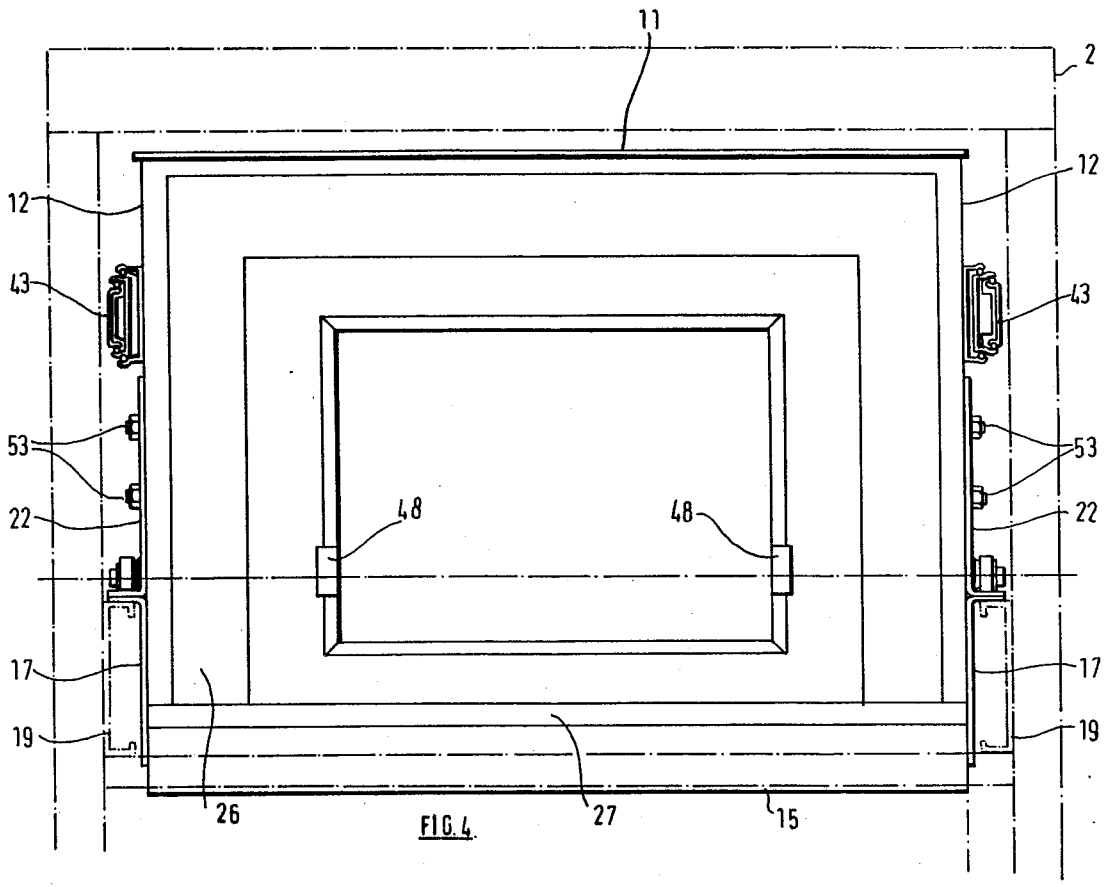
FIG. 4 is a front view of the filing cabinet with the fire-resistant container installed therein.

FIG. 4 is front view of the upper region of the filing cabinet 1 with the filing drawer 3 removed and showing the mounting of the fire-resistant container within the filing cabinet.

Figure 5:
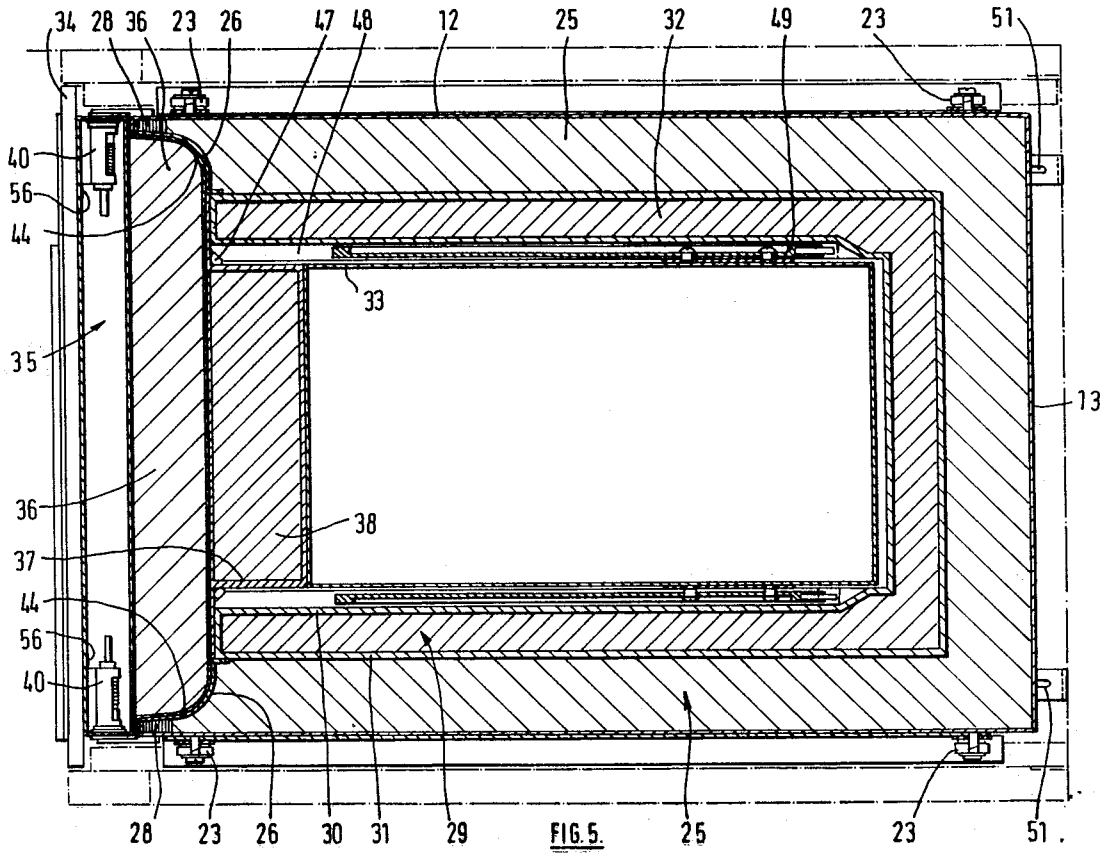
FIG. 5 is plan view in section of the fire-resistant container mounted in the filing cabinet.

FIG. 5 is sectional plan view of the fire-resistant container mounted in the filing cabinet 1 and showing the internal construction of the fire-resistant container.

In the filing cabinet shown in the drawings the filing drawer 3 comprises a body of thermal insulation material which is enclosed within a casing 10 of steel or other suitable material. The casing 10 may be formed with indentations (not shown) for additional rigidity. The casing includes a top 11, side walls 12 and a rear wall 13, the side walls of the casing being joined together in the lower region thereof by means of a tie piece 24 which is formed as a decorative roll-over component with angle pieces at each end for securing to the side walls 12, for example by spot welding. The base of the casing 10 is formed by a separate block 14 of thermal insulation material which is mounted in a tray 15 of steel or other suitable material which is secured in the outer casing 2 of the filing cabinet. The tray 15 is mounted in the outer casing 2 by means of a mounting bracket 16 arranged at the rear of the casing and secured to the casing 2 by any suitable means such as spot welding or metal screws. The supporting portion of the bracket 16 is secured to the tray 15 by way of metal screws 50 which extend through elongate slots 51 to permit vertical adjustment of the tray 15 relative to the outer casing 2. Further support for the tray 15 is provided by angle brackets 17 mounted on each longitudinal side of the tray 15 and which are secured to the tray 15 by means of metal screws 52 which pass through elongate slots 18 formed in the angle brackets 17. The upper edge of the angle brackets 17 is bent outwardly and locates on a channel section 19 which is conventionally provided in the filing cabinet 1 for the usual filing drawer such as 4, 5 or 6. The angle brackets 17 are also formed with two locating slots 21 the purpose of which will be described in more detail hereinafter.

The casing 10 containing the body of thermal insulation material is mounted in the filing cabinet 1 with the aid of angle brackets 22 which are secured to the sides of the casing 10 by way of metal screws 53 which pass through elongate slots 54 provided in the brackets 22 and permitting vertical adjustment of the brackets relative to the casing 10. The angle brackets 22 are formed with an outwardly extending lower edge which is engageable on the outwardly extending edge of the angle brackets 17. Towards each end of the angle brackets 22 there is provided a roller 23 which extends through a slot provided in the outwardly extending edge of the brackets 22. The casing 10 is installed on the tray 15 by rolling the casing 10 along the outwardly extending edge of brackets 17 until the rollers 23 engage in the locating slots 21. The casing 10 and the tray 15 are then permanently united, for example by means of screws (not shown) inserted through the tray and into the body of insulation material in the casing 10.

The casing 10 contains a body of thermal insulation material 25 at the top, rear and sides thereof. The insulation material is preferably a microporous thermal insulation material based upon pyrogenic silica and an opacifier. A suitable microporous thermal insulation material is sold under the registered trade mark MICROTHERM. The same insulation material may be used in the tray 15. The pyrogenic silica may be treated to render it hydrophobic. The outer edge of the insulation material 25 is profiled as will be explained in more detail hereinafter, as is the outer edge of the thermal insulation material in the tray 15 and the profiled sections are provided with liners 26, 27 which may, for example, be made from vacuum formed high impact polystyrene to improve the resistance of these sections to abrasion and damage. The outermost portions of the profiled edges of the bodies 14, 25 of thermal insulation material may incorporate an intumescent material 55, 28 respectively. The intumescent material may be a material such as that sold under the trade marks FIREC or CHARTEK which will intumesce and fill any gaps in the event of a fire.

Within the body 25 of insulation material there is provided an inner container 29 having an inner wall 30 and an outer wall 31. The container may be made of any suitable material, preferably having a high specific heat. Suitable materials include polyurethane structural foam which may be formed by injection moulding and polyvinyl chloride, polyethylene, ethylene, vinyl acetate copolymer or nylon which may be formed by rotational moulding. Alternatively, the inner wall 30 and the outer wall 31 may be made of sheet metal with the inner and outer walls being joined by a spacer 31A, for example of a high specific heat material such as a plastics material, which inhibits heat flow from the outer wall 31 to the inner wall 30. Between the inner and outer walls of the inner container 29 there is a heat absorbing material 32 for example a phase change material such as sodium acetate trihydrate which has a particularly high latent heat of fusion. A suitable form of sodium acetate trihydrate is sold under the trade mark CALORTHERM 48.

Mounted within the cavity of the inner container 29 is a storage drawer 33, which may be made, for example, of sheet metal having a decorative finish. The drawer 33 will hold a number of floppy disks, data cassettes or other items required to be protected from fire. The storage drawer 33 is mounted on the front 34 of the filing cabinet 1 by way of a metal spacer frame 35, a layer 36 of thermal insulation material and a container 37 for a heat absorbing material 38.

The drawer front 34 preferably matches the fronts of the remaining drawers so that the fire-resistant cabinet does not appear out of place in the filing cabinet. The metal spacer frame 35 is secured to the drawer front 34 by way of a fastening (not shown) which is readily broken if the filing cabinet becomes distorted, for example as a result of an impact during a fire, so that the drawer front 34 does not bear against the outer casing 2 of the filing cabinet to disrupt the sealing of the fire-resistant container. Suitable fastening means includes low melting point solder and bolts which readily shear. Mounted on one side of the metal spacer frame 35 is a bracket 39 which is co-operable with the locking system (not shown) of the filing cabinet so as to enable the fire-resistant container to be locked if the other filing drawers 4, 5, 6 are locked. Secured within each side of the metal spacer frame are two spring-loaded bolts 40 which are engageable with apertures provided through co-operating plates 41 secured to the casing 10. The spring-loaded bolts 40 are temperature actuated and are thermally linked to the front 34 of the drawer 3 by way of an element 56 so that in the event of a fire the bolts 40 are actuated and engage with the apertures in the plates 41 to prevent the fire-resistant container from opening inadvertently. Numerous temperature-sensitive materials can be used to hold the bolts in their initial position, one example being a low-temperature solder. The bolts 40 may be removed from engagement with the apertures in the plates 41 by any suitable means inserted through apertures 42 provided in the outer casing 2 of the filing cabinet.

Also mounted on each side of the spacer frame 35 is one end of a slider mechanism 43 which at its other end is secured to the casing 10. The slider mechanism may be any one of a number of well-known constructions and is not described in detail herein, but serves to support the drawer front 34 when it is withdrawn from the filing cabinet.

The layer 36 of thermal insulation material may be moulded from the same material as the body 25 of insulation material. The surface of the layer 36 is profiled to co-operate with the profiles of the body 25 and of the material in the tray 15, the profiles being advantageous in preventing the penetration of radiation into the storage drawer 33. The layer 36 is also covered with a protective liner 44 for example of vacuum formed high impact polystyrene.

The container 37 may be made of the same material as the container 29 and the heat absorbing material 38 may be the same as the material 32. The heat absorbing material 38 is melted and poured into the container 37 by way of a filling hole which is subsequently sealed with a plug 45. The container 37 and the layer 36 are secured to the spacer frame 35 by means of a tie bolt 46, for example of nylon, which is threaded into the plug 45. A seal 47 for example of compressible closed cell rubber is positioned around the container 37 adjacent to the layer 36 as an additional precaution against the influx of heat. When the fire-resistant container is closed, the container 37 extends into the interior of the container 29 and is a close fit therewith in order to eliminate as far as possible the influx of heat into the storage drawer 33. When the drawer front 34 is closed, it may be retained temporarily in position by means of magnetic catches (not shown).

When the storage drawer 33 is withdrawn from the container 29 in order to gain access to the contents of the drawer, it is possible for the weight of the contents of the drawer or for the user to push downwardly on the drawer so as to prevent the drawer re-locating in the container 29. In order to avoid this possibility a longitudinal recess 48 is formed in the inner wall of the container 29 and a slide mechanism 49 attached to the storage drawer 33 runs in the recess 48 in order to support the rear of the drawer.

The vertical adjustment capability of the angle brackets 17, 22 combined with the horizontal adjustment capability of the fixings of the mounting bracket 16 enable the fire-resistant container to be adapted to a large number of existing filing cabinets with a minimum of modification to the filing cabinet. Alternatively, it is possible to mount the fire-resistant container into a decorative casing in the form of a single-drawer filing cabinet.

I claim:

1. A method of assembling a fire-resistant container for magnetic media into a filing cabinet incorporating a casing having a front open face and at least one recess dimensioned to receive a filing drawer of conventional dimensions, which method comprises the steps of:

fitting a base of thermal insulation material securely to the casing of the filing cabinet, the base extending between side walls of the casing and from the region of the open face of the casing towards the rear thereof;

positioning on the base and within the casing a body of thermal insulation material which incorporates a heat absorbing material and securing the body to the base, the body comprising side walls, a rear wall and a top, the side walls and the rear wall engaging with the base so as to define therewith a storage cavity which opens towards the front open face of the casing; and inserting into the storage cavity a storage drawer having a facing to co-operate with the front open face of the casing, which storage drawer is provided with a body of thermal insulation material which body, in use, co-operates with the body defining the storage cavity so as to close and insulate the storage cavity.

2. A method of assembling a fire-resistant container for magnetic media into a filing cabinet incorporating a casing having a front open face and constructed to receive at least one filing drawer, which method comprises the steps of:

fitting a base of thermal insulation material securely to the casing of the filing cabinet, the base extending between side walls of the casing and from the region of the open face of the casing towards the rear thereof;

providing a mounting rail along each side of the casing internally thereof, the mounting rail extending substantially from the front of the casing towards the rear thereof;

providing angle brackets on each side of the base, the angle brackets including a member extending substantially from the front of the base towards the rear thereof and co-operable with the mounting rail, the angle brackets including means permitting vertical adjustment thereof relative to the base;

positioning on the base and within the casing a body of thermal insulation material which incorporates a heat absorbing material and securing the body to the base, the body comprising side walls, a rear wall and a top, the side walls and the rear wall engaging with the base so as to define therewith a storage cavity which opens towards the front open face of the casing; and inserting into the storage cavity a storage drawer having a facing to co-operate with the front open face of the casing, which storage drawer is provided with a body of thermal insulation material, which body, in use, co-operates with the body defining the storage cavity so as to close and insulate the storage cavity.

3. A method according to claim 2, wherein a mounting rail is provided along each side of the casing internally thereof and extends substantially from the front of the casing towards the rear thereof, and wherein angle brackets are provided on each side of the body to thermal insulation material and include a member extending substantially from the front of the body towards the rear thereof and co-operable with the mounting rail, the angle brackets including means permitting vertical adjustment thereof relative to the body.

4. A method according to claim 3, wherein rollers are provided on the angle brackets attached to the body of thermal insulation material and are engageable so as to roll on the angle brackets provided on each side of the base to facilitate positioning of the body of thermal insulation material relative to the base.

* * * * *